US011211031B2

(12) United States Patent
An

(10) Patent No.: US 11,211,031 B2
(45) Date of Patent: Dec. 28, 2021

(54) DISPLAY DEVICE AND DRIVING METHOD THEREOF IN DIFFERENT FREQUENCIES

(71) Applicant: Samsung Display Co., Ltd., Yongin-si (KR)

(72) Inventor: Ju Bong An, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/844,347

(22) Filed: Apr. 9, 2020

(65) Prior Publication Data

US 2020/0335061 A1 Oct. 22, 2020

(30) Foreign Application Priority Data

Apr. 16, 2019 (KR) ..... 10-2019-0044486

(51) Int. Cl.
*G09G 5/10* (2006.01)

(52) U.S. Cl.
CPC ..... *G09G 5/10* (2013.01); *G09G 2320/0233* (2013.01); *G09G 2320/0626* (2013.01)

(58) Field of Classification Search
CPC ..... G09G 5/10; G09G 2320/0233; G09G 2320/0626; G09G 2300/0842; G09G 2310/0262; G09G 2310/0286; G09G 2300/0819; G09G 2300/0861; G09G 3/3266; G09G 3/20; G09G 3/32; G09G 3/3208
See application file for complete search history.

(56) References Cited

U.S. PATENT DOCUMENTS 10,665,177 B2 * 5/2020 Wu ..... G09G 3/3406
11,037,495 B2 * 6/2021 Orio ..... G09G 3/3241
2007/0247417 A1 * 10/2007 Miyazaki ..... G09G 3/344 345/107

FOREIGN PATENT DOCUMENTS

KR 10-2018-0073112 A 7/2018

* cited by examiner

*Primary Examiner* — Rodney Amadiz
(74) *Attorney, Agent, or Firm* — Lewis Roca Rothgerber Christie LLP

(57) ABSTRACT

A driving method of a display device includes supplying a pixel with a first light emission stop pulse having a first pulse width during a first frame that is driven at a first frequency; supplying the pixel with a second light emission stop pulse having a second pulse width during a second frame that is driven at a second frequency; and supplying the pixel with a third light emission stop pulse having a third pulse width during a third frame that is driven at the second frequency. The first frequency is different from the second frequency. The second pulse width is between the first pulse width and the third pulse width.

20 Claims, 12 Drawing Sheets

DISPLAY DEVICE AND DRIVING METHOD THEREOF IN DIFFERENT FREQUENCIES

CROSS-REFERENCE TO RELATED APPLICATION

This application claims priority to and the benefit of Korean Patent Application No. 10-2019-0044486 filed in the Korean Intellectual Property Office on Apr. 16, 2019, the entire contents of which are incorporated herein by reference.

BACKGROUND

1. Field

Aspects of some example embodiments of the present invention relate to a display device and a driving method thereof.

2. Description of the Related Art

As information technology is developed, the importance of display devices, which are a connection medium between a user and information, has increased. In response to this, the use of a display device such as a liquid crystal display device, an organic light emitting display device, or a microLED display device has been increasing.

The number of frames to be displayed per second varies depending on a driving frequency of the display device. For example, when the display device is driven at a frequency of 60 Hz, the display device may display 60 frames per second. Similarly, when the display device is driven at a frequency of 90 Hz, the display device may display 90 frames per second.

The above information disclosed in this Background section is only for enhancement of understanding of the background and therefore the information discussed in this Background section does not necessarily constitute prior art.

SUMMARY

Aspects of some example embodiments of the present invention may include a display device and a driving method thereof that may reduce or minimize an instantaneous luminance change when a driving frequency of the display device is changed.

A driving method of a display device according to some example embodiments of the present invention includes supplying a pixel with a first light emission stop pulse having a first pulse width during a first frame that is driven at a first frequency; supplying the pixel with a second light emission stop pulse having a second pulse width during a second frame that is driven at a second frequency; and supplying the pixel with a third light emission stop pulse having a third pulse width during a third frame that is driven at the second frequency, in which the first frequency is different from the second frequency and the second pulse width is between the first pulse width and the third pulse width.

According to some example embodiments, the first frequency may be lower than the second frequency, and the second pulse width may be smaller than the first pulse width and is larger than the third pulse width.

According to some example embodiments, at least one light emission stop pulse having the first pulse width may be further supplied to the pixel during the first frame.

According to some example embodiments, at least one light emission stop pulse having the third pulse width may be further supplied to the pixel during the third frame.

According to some example embodiments, at least one light emission stop pulse having the third pulse width may be further supplied to the pixel during the second frame, following the second light emission stop pulse.

According to some example embodiments, at least one fourth light emission stop pulse having a fourth pulse width that is between the second pulse width and the third pulse width may be further supplied to the pixel during the second frame, following the second light emission stop pulse.

According to some example embodiments, at least one fifth light emission stop pulse having a fifth pulse width smaller than the fourth pulse width and larger than or equal to the third pulse width may be further supplied to the pixel during the second frame, following the fourth light emission stop pulse.

According to some example embodiments, the first frequency may be higher than the second frequency, and the second pulse width may be larger than the first pulse width and may be smaller than the third pulse width.

According to some example embodiments, at least one light emission stop pulse having the first pulse width may be further supplied to the pixel during the first frame.

According to some example embodiments, at least one light emission stop pulse having the third pulse width may be further supplied to the pixel during the third frame.

According to some example embodiments, at least one light emission stop pulse having the third pulse width may be further supplied to the pixel during the second frame, following the second light emission stop pulse.

According to some example embodiments, at least one fourth light emission stop pulse having a fourth pulse width which is between the second pulse width and the third pulse width may be further supplied to the pixel during the second frame, following the second light emission stop pulse.

According to some example embodiments, at least one fifth light emission stop pulse having a fifth pulse width larger than the fourth pulse width and smaller than or equal to the third pulse width may be further supplied to the pixel during the second frame, following the fourth light emission stop pulse.

A display device according to some example embodiments of the present invention includes: a light emission driver; a first pixel which is coupled to a first light emission line extending from the light emission driver; and a second pixel that is connected to a second light emission line which extends from the light emission driver and differs from the first light emission line. The light emission driver supplies a first pixel with a first light emission stop pulse having a first pulse width during a first frame that is driven at a first frequency, supplies the first pixel with a second light emission stop pulse having a second pulse width during a second frame that is driven at a second frequency, and supplies the first pixel with a third light emission stop pulse having a third pulse width during a third frame that is driven at the second frequency. The light emission driver supplies light emission stop pulses to the second pixel at a different time from the first pixel, in each frame. The second pulse width is between the first pulse width and the third pulse width.

According to some example embodiments, the first frequency may be lower than the second frequency, the second pulse width may be smaller than the first pulse width and larger than the third pulse width, the light emission driver may further supply the first pixel with at least one light emission stop pulse having the first pulse width during the first frame, and the light emission driver may further supply the first pixel with at least one light emission stop pulse having the third pulse width during the third frame.

According to some example embodiments, the light emission driver may further supply the first pixel with at least one light emission stop pulse having the third pulse width during the second frame, following the second light emission stop pulse.

According to some example embodiments, the light emission driver may further supply the first pixel with at least one fourth light emission stop pulse having a fourth pulse width between the second pulse width and the third pulse width during the second frame, following the second light emission stop pulse, and the light emission driver may further supply the first pixel with at least one fifth light emission stop pulse having a fifth pulse width smaller than the fourth pulse width and larger than or equal to the third pulse width during the second frame, following the fourth light emission stop pulse.

According to some example embodiments, the first frequency may be higher than the second frequency, the second pulse width may be larger than the first pulse width and smaller than the third pulse width, the light emission driver may further supply the first pixel with at least one light emission stop pulse having the first pulse width during the first frame, and the light emission driver may further supply the first pixel with at least one light emission stop pulse having the third pulse width during the third frame.

According to some example embodiments, the light emission driver may further supply the first pixel with at least one light emission stop pulse having the third pulse width during the second frame, following the second light emission stop pulse.

According to some example embodiments, the light emission driver may further supply the first pixel with at least one fourth light emission stop pulse having a fourth pulse width between the second pulse width and the third pulse width during the second frame, following the second light emission stop pulse, and the light emission driver may further supply the first pixel with at least one fifth light emission stop pulse having a fifth pulse width larger than the fourth pulse width and smaller than or equal to the third pulse width during the second frame, following the fourth light emission stop pulse.

A display device and a driving method thereof according to the present invention may reduce or minimize an instantaneous luminance change when a driving frequency of the display device is changed.

BRIEF DESCRIPTION OF THE DRAWINGS

A more complete appreciation of the present invention, and many of the attendant features and aspects thereof, will become more readily apparent with reference to the following detailed description when considered in conjunction with the accompanying drawings in which like reference symbols indicate like components, wherein.

DETAILED DESCRIPTION

Figure 1:
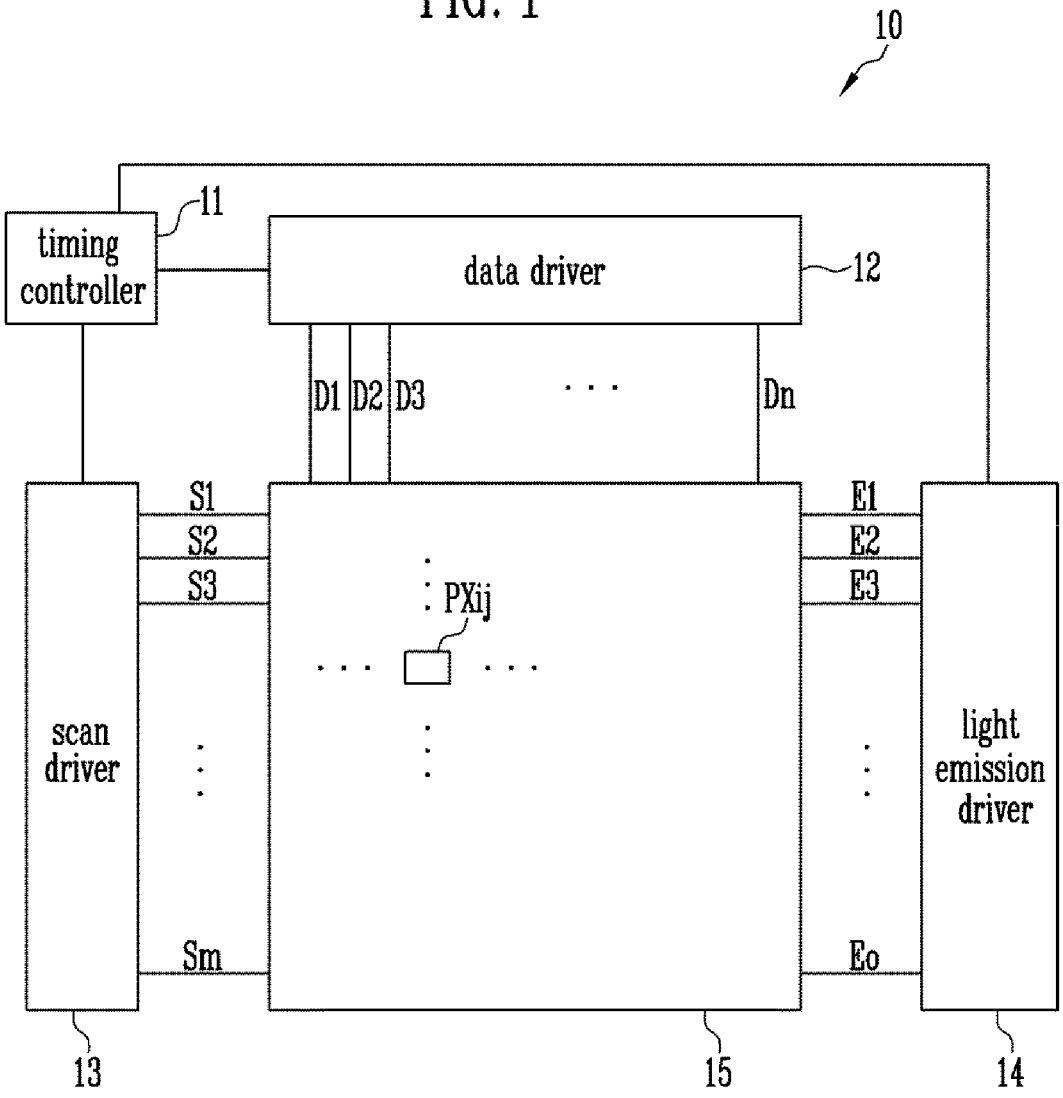
FIG. 1 is a diagram illustrating a display device according to some example embodiments of the present invention.

Hereinafter, aspects of some example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to"

another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The display device and/or any other relevant devices or components according to embodiments of the present invention described herein may be implemented utilizing any suitable hardware, firmware (e.g., an application-specific integrated circuit), software, or a combination of software, firmware, and hardware. For example, the display device may include a timing controller, a data driver, a scan driver, a light emission driver, and a pixel unit. The various components may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. Also, a person of skill in the art should recognize that the functionality of various computing devices may be combined or integrated into a single computing device, or the functionality of a particular computing device may be distributed across one or more other computing devices without departing from the spirit and scope of the example embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Referring to FIG. 1, a display device 10 according to some example embodiments of the present invention includes a timing controller 11, a data driver 12, a scan driver 13, a light emission driver 14, and a pixel unit 15.

The timing controller 11 may receive gray scale values and control signals for each frame from an external processor. The timing controller 11 may render the gray scale values so as to correspond to a specification of the display device 10. For example, the external processor may provide a red gray scale value, a green gray scale value, and a blue gray scale value for each unit dot. However, for example, when the pixel unit 15 has a Pentile® structure (Pentile is a registered trademark of Samsung Display Co., LTD), adjacent unit dots share the pixel, and thus, the pixels may not correspond to the respective gay scale values on a one-to-one basis. In this case, rendering of the gray scale values is required. When the pixels correspond to the respective gray scale values on a one-to-one basis, rendering of the gray scale values may be not required. The gradation values that are rendered or not rendered may be provided to the data driver 12. The timing controller 11 may provide control signals suitable for each specification to the data driver 12, the scan driver 13, the light emission driver 14, and the like to display a frame.

The data driver 12 may generate the data voltages to be provided to data lines D1, D2, D3 to Dn using the gray scale values and the control signals. For example, the data driver 12 may sample the gray scale values using a clock signal and apply the data voltages corresponding to the gray scale values to the data lines D1 to Dn in units of pixel lines (n may be an integer greater than zero).

The scan driver 13 may receive a clock signal, a scan start signal, and the like from the timing controller 11, and generate scan signals to be provided to scan lines S1, S2, S3 to Sm (m may be an integer greater than zero).

The scan driver 13 may supply (e.g., sequentially supply) the scan signals having pulses of a turn-on level to the scan lines S1, S2, S3 to Sm. The scan driver 13 may include scan stages configured in the form of shift registers. The scan driver 13 may generate the scan signals in a manner of sequentially transmitting the scan start signal, which is a pulse form of a turn-on level, to a next scan stage under a control of the clock signal.

The light emission driver 14 may receive the clock signal, a light emission stop start signal, and the like from the timing controller 11 and generate light emission signals to be provided to light emission lines E1, E2, E3 to Eo. For example, the light emission driver 14 may provide (e.g., sequentially provide) the light emission signals having pulses of a turn-off level to the light emission lines E1 to Eo. For example, each of the light emission stages of the light emission driver 14 may be configured in the form of a shift register and generate the light emission signals in a manner of sequentially transmits the light emission stop start signal, which is a pulse shape of a turn-off level, to a next light emission stage under the control of the clock signal. o may be an integer greater than zero.

The pixel unit 15 includes a plurality of pixels PXij (i and j may be natural numbers). Each of pixels PXij may be connected to a corresponding data line, a corresponding scan line, and a corresponding light emission line. In addition, the pixels PXij may be connected to a first power supply line and a second power supply line. The pixel PXij may refer to a pixel in which a scan transistor is connected to the i-th scan line and the j-th data line.

Figure 2:
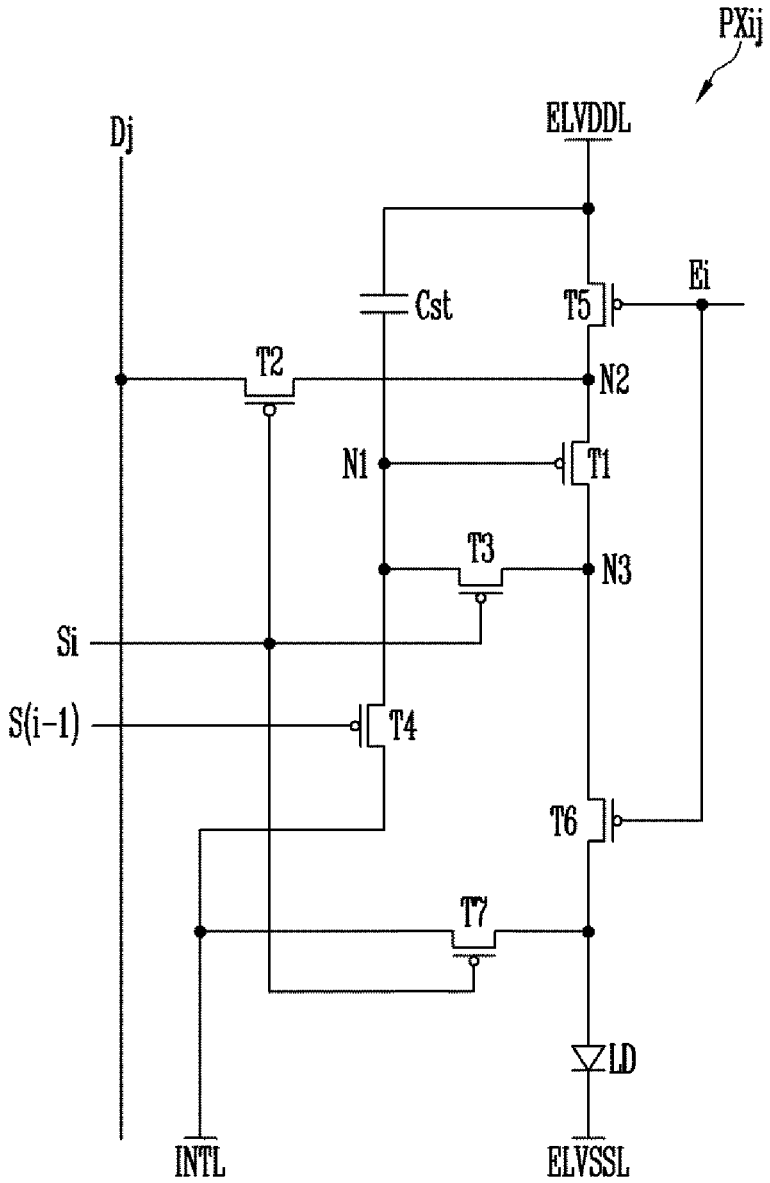
FIG. 2 is a diagram illustrating a pixel according to some example embodiments of the present invention.

FIG. 2 is a diagram illustrating a pixel according to some example embodiments of the present invention.

Referring to FIG. 2, the pixel PXij includes transistors T1, T2, T3, T4, T5, T6, and T7, a storage capacitor Cst, and a light emitting diode LD.

Hereinafter, a circuit configured with P-type transistors will be described as an example. However, those skilled in the art will be able to design a circuit configured with N-type transistors by differently setting polarities of voltages applied to gate terminals thereof. Similarly, those skilled in the art will be able to design a circuit configured with a combination of P-type transistors and N-type transistors. The P-type transistors are collectively referred to as a transistor in which a current flowing when a voltage difference between a gate electrode and a source electrode increases in the negative direction increases. N-type transistors are collectively referred to as a transistor in which a current flowing when a voltage difference between the gate electrode and the source electrode increases in the positive direction increases. The transistor may be formed in various forms such as a thin film transistor (TFT), a field effect transistor (FET), and a bipolar junction transistor (BJT).

A transistor T1 has a gate electrode connected to a first node N1, a first electrode connected to a second node N2, and a second electrode connected to a third node N3. The transistor T1 may be referred to as a driving transistor.

A transistor T2 may have a gate electrode connected to an i-th scan line Si, a first electrode connected to a data line Dj, and a second electrode connected to the second node N2. The transistor T2 may be referred to as a scan transistor.

A transistor T3 may have a gate electrode connected to the i-th scan line Si, a first electrode connected to the first node N1, and a second electrode connected to a third node N3. The transistor T3 may be referred to as a diode-connected transistor.

A transistor T4 may have a gate electrode connected to an (i−1)-th scan line S(i−1), a first electrode connected to the first node N1, and a second electrode connected to an initialization line INTL. According to some example embodiments, the gate electrode of transistor T4 may be connected to another scan line. The transistor T4 may be referred to as a gate initialization transistor.

A transistor T5 may have a gate electrode connected to an i-th light emission line Ei, a first electrode connected to a first power supply line ELVDDL, and a second electrode connected to the second node N2. The transistor T5 may be referred to as a light emission transistor. According to some example embodiments, the gate electrode of the transistor T5 may be connected to another light emission line.

A transistor T6 may have a gate electrode connected to the i-th light emission line Ei, a first electrode connected to the third node N3, and a second electrode connected to an anode of the light emitting diode LD. The transistor T6 may be referred to as a light emission transistor. According to some example embodiments, the gate electrode of the transistor T6 may also be connected to another light emission line.

A transistor T7 may have a gate electrode connected to the i-th scan line, a first electrode connected to the initialization line INTL, and a second electrode connected to the anode of the light emitting diode LD. The transistor T7 may be referred to as an anode initialization transistor. According to some example embodiments, the gate electrode of transistor T7 may be connected to another scan line.

A first electrode of the storage capacitor Cst may be connected to the first power supply line ELVDDL and a second electrode may be coupled to the first node N1.

The light emitting diode LD may have an anode connected to the second electrode of the transistor T6 and a cathode connected to the second power supply line ELVSSL. The light emitting diode LD may include an organic light emitting diode, an inorganic light emitting diode, or a quantum dot light emitting diode.

A first power supply voltage may be applied to the first power supply line ELVDDL, a second power supply voltage may be applied to the second power supply line ELVSSL, and an initialization voltage may be applied to the initialization line INTL.

Figure 3:
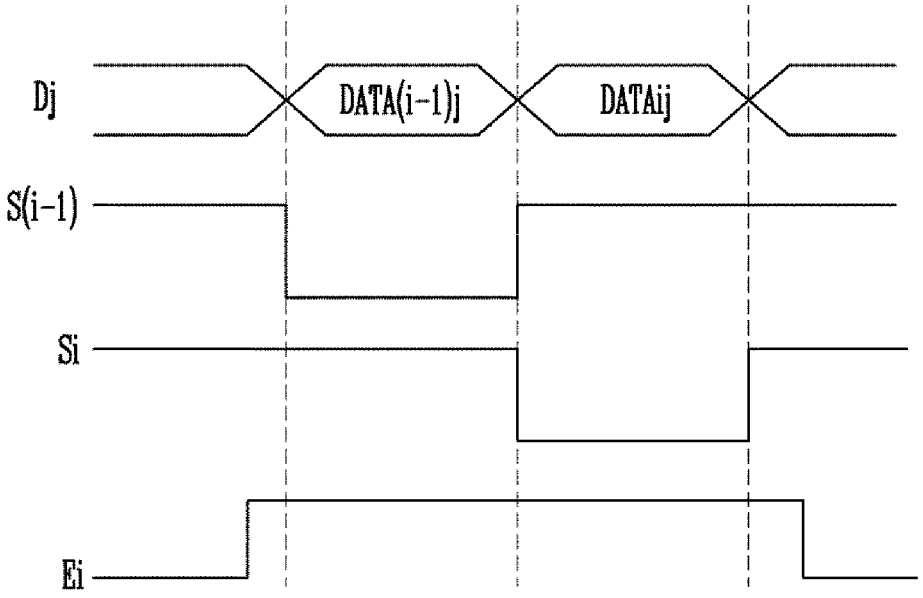
FIG. 3 is a diagram illustrating a method of driving a pixel according to some example embodiments of the present invention.

FIG. 3 is a diagram illustrating a method of driving the pixel according to some example embodiments of the present invention.

A data voltage DATA(i−1)j for the (i−1)-th pixel is applied to the data line Dj and the scan signal of a turn-on level is applied to the (i−1)-th scan line S(i−1).

Because the scan signal of a turn-off level (high level) is applied to the i-th scan line Si, the transistor T2 is turned off, and the data voltage DATA(i−1)j for the (i−1)-th pixel is prevented from inputting to the pixel PXij.

Because the transistor T4 is turned on, the first node N1 is connected to the initialization line INTL, and a voltage of the first node N1 is initialized. Because the light emission signal of a turn-off level is applied to the i-th light emission line Ei, the transistors T5 and T6 are in a turn-off state, and an unnecessary light emission of the light emitting diode LD according to an initialization voltage application process is prevented.

A data voltage DATAij for the i-th pixel PXij is applied to the data line Dj, and the scan signal of a turn-on level is applied to the i-th scan line Si. Accordingly, the transistors T2, T1, and T3 are turned on, and the data line Dj is electrically connected to the first node N1. Accordingly, a compensation voltage obtained by subtracting a threshold voltage of the transistor T1 from the data voltage DATAij is applied to the second electrode (that is, the first node N1) of the storage capacitor Cst, and the storage capacitor Cst maintains a voltage corresponding to a difference between the first power supply voltage and the compensation voltage. This period may be referred to as a threshold voltage compensation period.

At this time, the transistor T7 is in a turn-on state, and thereby, the anode of the light emitting diode LD is connected to the initialization line INTL, and the light emitting diode LD is precharged with a charge amount corresponding to a voltage difference between the initialization voltage and the second power supply voltage (e.g., initialized).

As the light emission signal of a turn-on level is applied to the light emission line Ei, the transistors T5 and T6 may be turned on. Therefore, a path of the first power supply line ELVDDL, the transistor T5, the transistor T1, the transistor T6, the light emitting diode LD, and the second power supply line ELVSSL is formed as a driving current path.

The driving current flowing through the first electrode and the second electrode of the transistor T1 is adjusted according to a voltage held in the storage capacitor Cst. The light emitting diode LD emits light with a luminance corresponding to the driving current. The light emitting diode LD emits the light until a light emission signal of a turn-off level is applied to the light emission line Ei.

Figure 4:
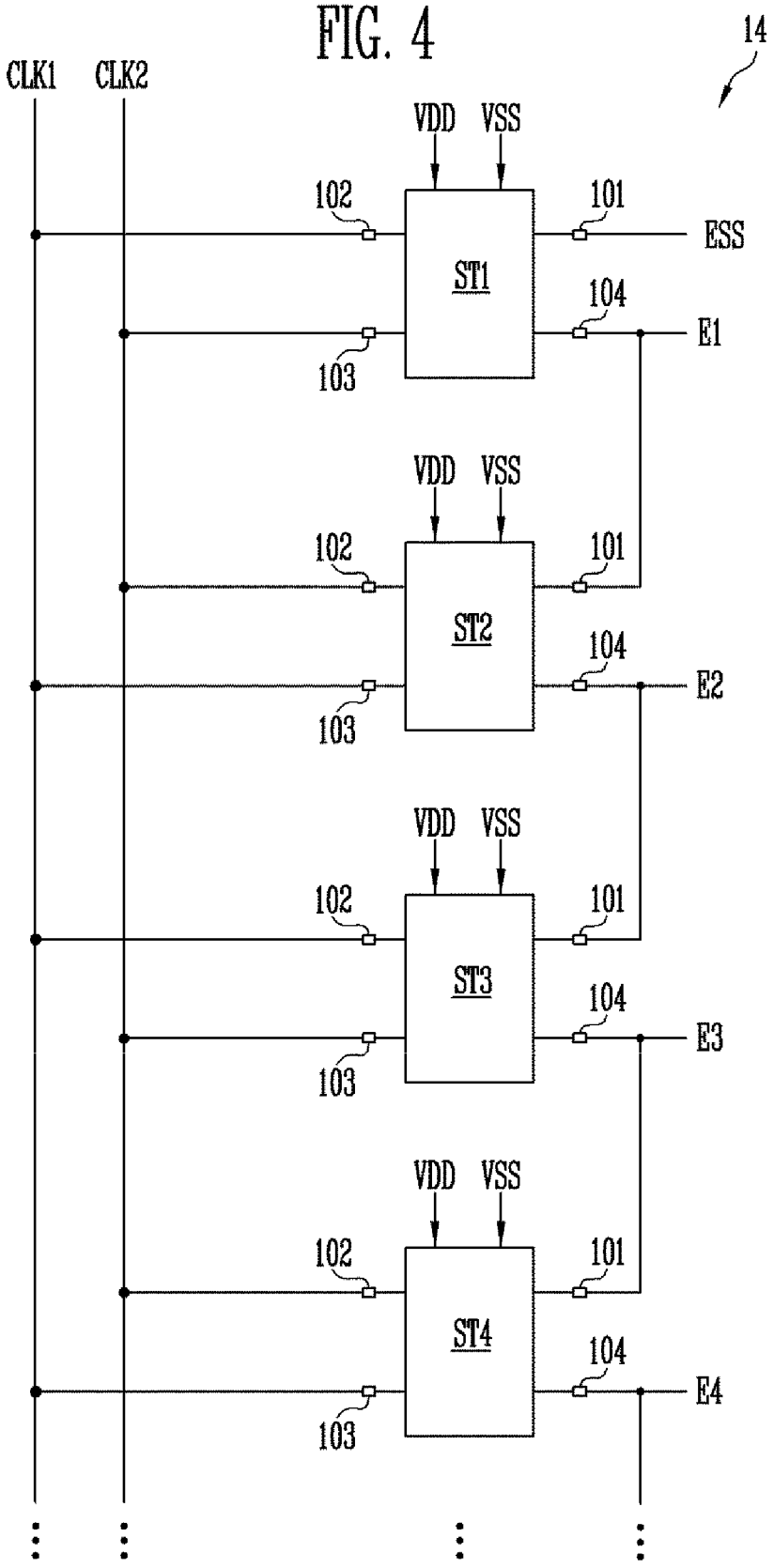
FIG. 4 is a diagram illustrating a light emission driver according to some example embodiments of the present invention.

FIG. 4 is a diagram illustrating the light emission driver according to some example embodiments of the present invention.

FIG. 4 illustrates four light emission stages ST1, ST2, ST3, and ST4 for the sake of convenient description.

Referring to FIG. 4, the light emission driver 14 according to some example embodiments of the present invention may include a plurality of light emission stages ST1 to ST4. The light emission stages ST1 to ST4 may be connected to the corresponding light emission lines E1 to E4, respectively, and may be commonly connected to the clock lines CLK1 and CLK2. The light emission stages ST1 to ST4 may have substantially the same circuit structure.

Each of the light emission stages ST1 to ST4 may include a first input terminal 101, a second input terminal 102, a third input terminal 103, and an output terminal 104.

The first input terminal 101 may receive an output signal (e.g., a light emission signal) of a previous light emission stage or a light emission stop start signal ESS. For example, the first input terminal 101 of the first light emission stage ST1 may receive the light emission stop start signal ESS, and the first input terminals 101 of the remaining light emission stages ST2 to ST4 may receive the light emission signals of the respective previous light emission stages.

The second input terminal 102 of a jth (j is an integer) light emission stage may be connected to a first clock line CLK1, and the third input terminal 103 thereof may be connected to a second clock line CLK2. The second input terminal 102 of a (j+1)-th light emission stage may be connected to the second clock line CLK2, and the third input terminal 103 thereof may be connected to the first clock line CLK1. That is, the first clock line CLK1 and the second clock line CLK2 may be alternately connected to the second input terminal 102 and the third input terminal 103 of each light emission stage.

Pulses of the first clock signal applied to the first clock line CLK1 and pulses of the second clock signal applied to the second clock line CLK2 do not overlap each other in terms of time. At this time, each of the pulses may be a turn-on level.

The light emission stages ST1 to ST4 may receive the first power supply VDD and the second power supply VSS. The first power supply VDD may be set to a voltage of a turn-off level, and the second power supply VSS may be set to a voltage of a turn-on level. A voltage level of the light emission signal may be determined based on one of the first power supply VDD and the second power supply VSS.

Figure 5:
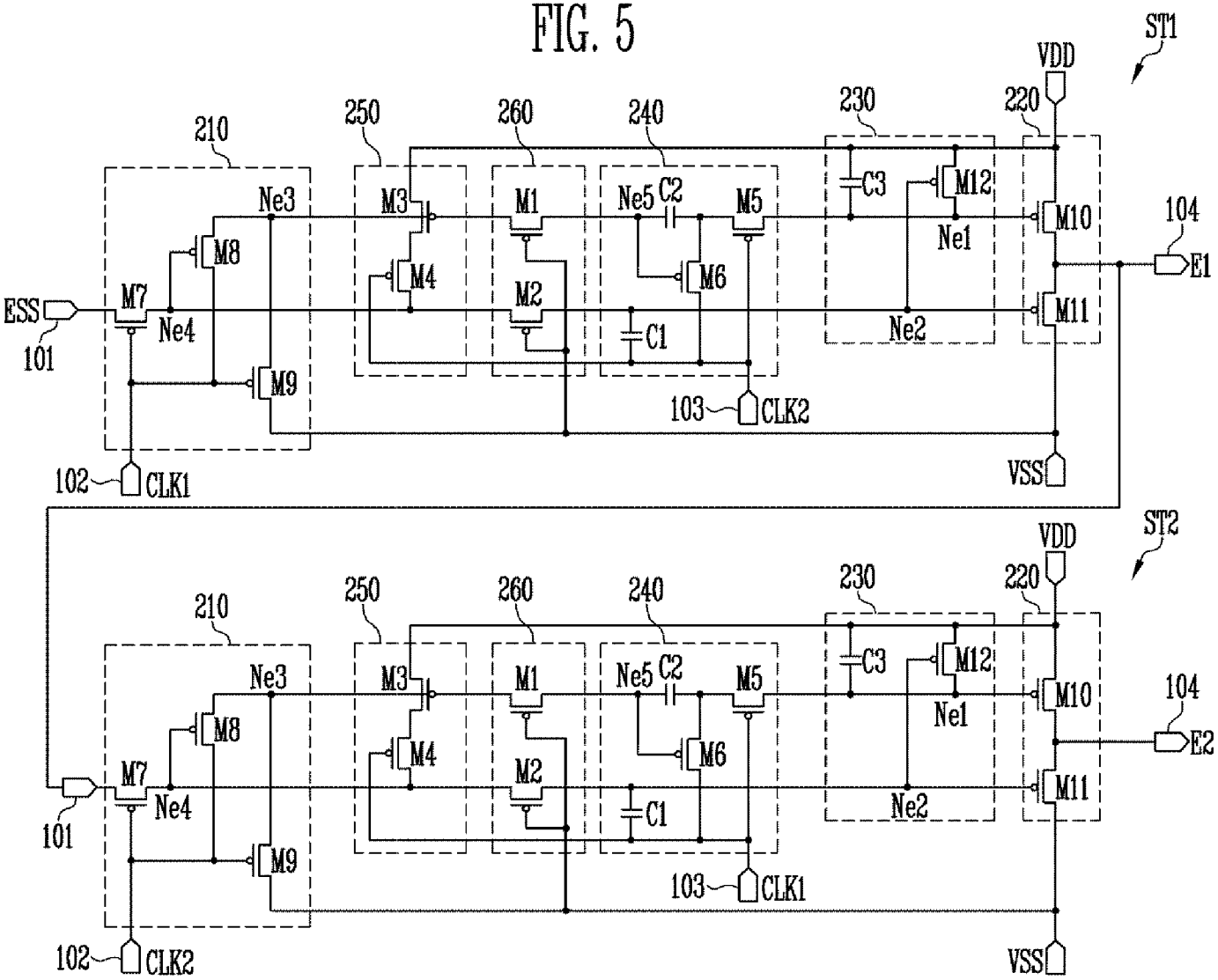
FIG. 5 is a diagram illustrating a light emission stage according to some example embodiments of the present invention.

FIG. 5 is a diagram illustrating the light emission stages according to some example embodiments of the present invention.

FIG. 5 illustrates two light emission stages ST1 and ST2 for the sake of convenient description.

Referring to FIG. 5, the first light emission stage ST1 according to some example embodiments of the present invention may include an input unit 210, an output unit 220, a first signal processing unit 230, a second signal processing unit 240, a third signal processing unit 250, and a first stabilization unit 260.

The output unit 220 may supply a voltage of a first power supply VDD or a voltage of a second power supply VSS to the output terminal 104 in response to voltages of a first node Ne1 and a second node Ne2. The output unit 220 may include a transistor M10 and a transistor M11.

The transistor M10 may be connected between the first power supply VDD and the output terminal 104. A gate electrode of the transistor M10 may be connected to the first node Ne1. The transistor M10 may be turned on or turned off in response to the voltage of the first node Ne1. For example, when the transistor M10 is turned on, the voltage of the first power supply VDD supplied to the output terminal 104 may be output as the light emission signal of a turn-off level through the first light emission line E1.

The transistor M11 may be connected between the output terminal 104 and the second power supply VSS. A gate electrode of the transistor M11 may be connected to the second node Ne2. The transistor M11 may be turned on or turned off in response to the voltage of the second node Ne2. For example, when the transistor M11 is turned on, the voltage of the second power supply VSS supplied to the output terminal 104 may be output as the light emission signal of a turn-on level through the first light emission line E1.

The input unit 210 may control voltages of a third node Ne3 and a fourth node Ne4 in response to signals supplied to the first input terminal 101 and the second input terminal 102. The input unit 210 may include a transistor M7, a transistor M8, and a transistor M9.

The transistor M7 may be connected between the first input terminal 101 and the fourth node Ne4. A gate electrode of the transistor M7 may be connected to the second input terminal 102. The transistor M7 may be turned on when the first clock signal of a turn-on level is supplied to the second input terminal 102 to electrically connect the first input terminal 101 to the fourth node Ne4.

The transistor M8 may be connected between the third node Ne3 and the second input terminal 102. A gate electrode of the transistor M8 may be connected to the fourth node Ne4. The transistor M8 may be turned on or turned off in response to a voltage of the fourth node Ne4.

The transistor M9 may be connected between the third node Ne3 and the second power supply VSS. A gate electrode of the transistor M9 may be connected to the second input terminal 102. The transistor M9 may be turned on when the first clock signal of a turn-on level is supplied to the second input terminal 102 to supply a voltage of the second power supply VSS to the third node Ne3.

The first signal processing unit 230 may control the voltage of the first node Ne1 in response to the voltage of the second node Ne2. The first signal processing unit 230 may include a transistor M12 and a third capacitor C3.

The transistor M12 may be connected between the first power supply VDD and the first node Ne1. A gate electrode of the transistor M12 may be connected to the second node Ne2. The transistor M12 may be turned on or turned off in response to the voltage of the second node Ne2.

The third capacitor C3 may be connected between the first power supply VDD and the first node Ne1. The third capacitor C3 may maintain a voltage applied to the first node Ne1.

The second signal processing unit 240 may be connected to a fifth node Ne5 and control the voltage of the first node Ne1 in response to a signal supplied to the third input terminal 103. The second signal processing unit 240 may include a transistor M5, a transistor M6, a first capacitor C1, and a second capacitor C2.

The first capacitor C1 may be connected between the second node Ne2 and the third input terminal 103. The first capacitor C1 may maintain a voltage difference between the third input terminal 103 and the second node Ne2.

A first terminal of the second capacitor C2 may be connected to the fifth node Ne5, and a second terminal thereof may be connected to the transistor M5.

The transistor M5 may be connected between the second terminal of the second capacitor C2 and the first node Ne1. A gate electrode of the transistor M5 may be connected to the third input terminal 103. The transistor M5 may be turned on when the second clock signal is supplied to the third input terminal 103 to electrically connect the second terminal of the second capacitor C2 to the first node Ne1.

The transistor M6 may be connected between the second terminal of the second capacitor C2 and the third input terminal 103. A gate electrode of the transistor M6 may be connected to the fifth node Ne5.

The third signal processing unit 250 may control a voltage of the fourth node Ne4 in response to the voltage of the third node Ne3 and a signal supplied to the third input terminal 103. The third signal processing unit 250 may include a transistor M3 and a transistor M4.

The transistor M3 and the transistor M4 may be connected in series between the first power supply VDD and the fourth node Ne4. A gate electrode of the transistor M3 may be connected to the third node Ne3. A gate electrode of the transistor M4 may be connected to the third input terminal 103.

The first stabilization unit 260 may be connected between the second signal processing unit 240 and the input unit 210. The first stabilization unit 260 may limit voltage drop widths of the third node Ne3 and the fourth node Ne4. The first stabilization unit 260 may include a transistor M1 and a transistor M2.

The transistor M1 may be connected between the third node Ne3 and the fifth node Ne5. A gate electrode of the transistor M1 may be connected to the second power supply VSS. The transistor M2 may be connected between the second node Ne2 and the fourth node Ne4. A gate electrode of the transistor M2 may be connected to the second power supply VSS.

The second light emission stage ST2 may have substantially the same configuration as the first light emission stage ST1 except signals supplied to the first input terminal 101, the second input terminal 102, and the third input terminal 103 as was described above.

Figure 6:
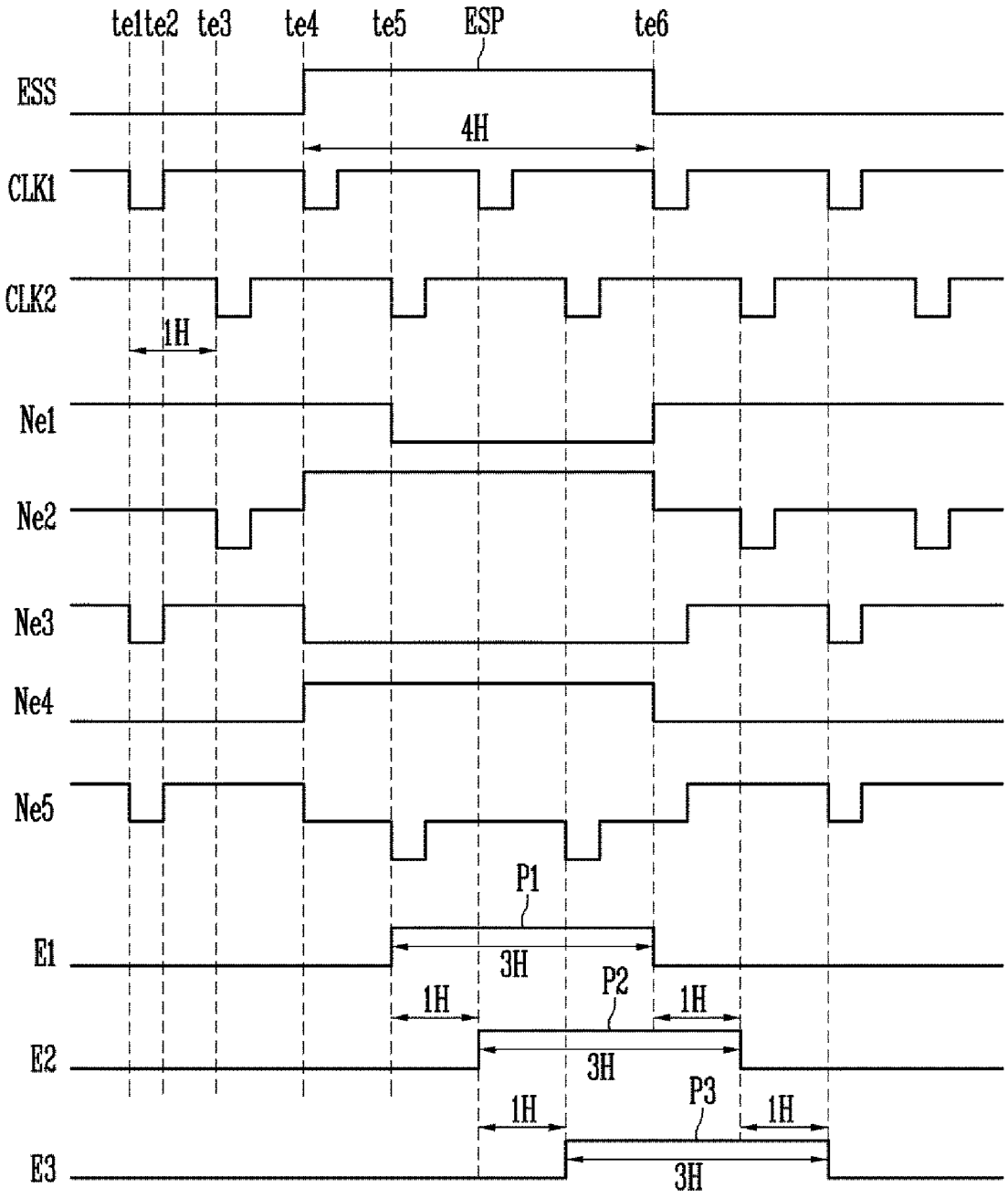
FIG. 6 is a diagram illustrating a driving method of the light emission stage according to some example embodiments of the present invention.

FIG. 6 is a diagram illustrating a method of driving the light emission stage according to some example embodiments of the present invention.

FIG. 6 illustrates a timing diagram with reference to the first light emission stage ST1.

Referring to FIG. 6, pulses of the first clock signal and pulses of the second clock signal are illustrated to each having a cycle of two horizontal periods and occurring in different horizontal periods. For example, the pulse of the second clock signal may be a signal shifted by a half cycle (e.g., one horizontal period 1H) based on the pulse of the first clock signal.

A light emission stop start pulse ESP of a turn-off level (e.g., a high level) of the light emission stop start signal ESS is set to overlap at least once with the pulse of a low level of the first clock signal supplied to the second input terminal 102. The light emission stop start pulse ESP may be supplied with a width larger than the pulse of the first clock signal (e.g., with four horizontal periods 4H). A pulse P1 of the first light emission signal supplied to the first input terminal 101 of the second light emission stage ST2 may also overlap at least once with the pulse of a low level of the clock signal supplied to the second input terminal 102 of the second light emission stage ST2.

The first clock signal of a low level is supplied to the second input terminal 102 at a first time point te1. For example, a pulse may be generated in the first clock signal. Accordingly, the transistor M7 and the transistor M9 may be turned on.

When the transistor M7 is turned on, the first input terminal 101 may be electrically connected to the fourth node Ne4. Because the transistor M2 maintains the turn-on state, the first input terminal 101 may be electrically connected to the second node Ne2 via the fourth node Ne4. The light emission stop start signal ESS of a high level is not supplied to the first input terminal 101 at the first time point te1, and thereby, a voltage of a low level (for example, VSS) may be supplied to the fourth node Ne4 and the second node Ne2.

When the voltage of a low level is supplied to the second node Ne2 and the fourth node Ne4, the transistor M8, the transistor M11, and the transistor M12 may be turned on.

When the transistor M12 is turned on, a voltage of the first power supply VDD is supplied to the first node Net, and thereby, the transistor M10 may be turned off.

When the transistor M11 is turned on, a voltage of the second power supply VSS may be supplied to the output terminal 104. Accordingly, the light emission signal of a low level may be supplied to the first light emission line E1 at the first time point te1.

When the transistor M8 is turned on, the first clock signal is supplied to the third node Ne3. Because the transistor M1 maintains the turn-on state, the first clock signal may be supplied to the fifth node Ne5 via the third node Ne3.

When the transistor M9 is turned on, the voltage of the second power supply VSS is supplied to the third node Ne3 and the fifth node Ne5. For example, the first clock signal may be at a low level, and thereby, the third node Ne3 and the fifth node Ne5 may be charged (e.g., stably charged) with the voltage of the second power supply VSS. Accordingly, the transistor M3 and the transistor M6 are turned on.

When the transistor M6 is turned on, the second clock signal of a high level (for example, VDD) is supplied to the second terminal of the second capacitor C2 from the third input terminal 103. Because the transistor M5 is in a turn-off state, the first node Ne1 may maintain the voltage of the first power supply VDD regardless of the fifth node Ne5 and the second terminal voltage of the second capacitor C2.

When the transistor M3 is turned on, the voltage of the first power supply VDD may be supplied to the transistor M4. At this time, the transistor M4 is in a turn-off state, and thereby, the fourth node Ne4 may maintain a low level.

At the second time point te2, the first clock signal of a high level is supplied to the second input terminal 102. For example, the pulse may disappear in the first clock signal. Accordingly, the transistor M7 and the transistor M9 may be turned off. At this time, the second node Ne2 and the first node Ne1 may maintain previous voltages by the first capacitor C1 and the third capacitor C3, and the transistor M8, the transistor M11, and the transistor M12 maintain the turn-on state.

When the transistor M8 is turned on, the first clock signal of a high level is supplied to the third node Ne3 and the fifth node Ne5 from the second input terminal 102. Thereby, the transistor M3 and the transistor M6 are set to a turn-off state.

At the third time point te3, the second clock signal of a low level is supplied to the third input terminal 103. For example, a pulse is generated in the second clock signal. Thereby, the transistor M4 and the transistor M5 are turned on.

If the transistor M5 is turned on, the second terminal of the second capacitor C2 is electrically connected to the first node Ne1. Because the transistor M12 is in a turn-on state, the first node Ne1 maintains a voltage of the first power supply VDD.

When the transistor M4 is turned on, the second electrode of the transistor M3 is electrically connected to the second node Ne2. Because the transistor M3 is in a turn-off state, the voltage of the first power supply VDD is not supplied to the fourth node Ne4 and the second node Ne2.

When the second clock signal of a low level is supplied to the third input terminal 103, a voltage of the second node Ne2 drops to a voltage lower than the voltage of the second power supply VSS by the coupling of the first capacitor C1. Thereby, the voltage applied to the gate electrodes of the transistors M11 and M12 drops to a voltage that is lower than the voltage of the second power supply VSS, and thus, driving characteristics of the transistors may be improved.

The fourth node Ne4 may substantially maintain the voltage of the second power supply VSS due to the transistor M2 regardless of a voltage drop of the second node Ne2. Because the voltage of the second power supply VSS is continuously applied to the gate electrode of the transistor M2, a voltage of the fourth node Ne4 corresponding to a source electrode of the transistor M2 does not drop to a voltage lower than a value obtained by adding a threshold voltage to the voltage of the second power supply VSS. Accordingly, a voltage difference between the first electrode and the second electrode of the transistor M7 is reduced (e.g., minimized), and thus, characteristic of the transistor M7 may be prevented from being changed.

At a fourth time point te4, the light emission stop start pulse ESP is supplied to the first input terminal 101, and the first clock signal of a low level is supplied to the second input terminal 102. For example a pulse is generated in the first clock signal. Thereby, the transistor M7 and the transistor M9 are turned on.

When the transistor M7 is turned on, the first input terminal 101 is electrically connected to the fourth node Ne4 and the second node Ne2. Accordingly, the fourth node Ne4 and the second node Ne2 are charged with a voltage of a high level, and the transistor M8, the transistor M11, and the transistor M12 are turned off.

When the transistor M9 is turned on, the voltage of the second power supply VSS is supplied to the third node Ne3 and the fifth node Ne5, and the transistor M3 and the transistor M6 are turned on. At this time, even when the transistor M3 is turned on, the voltage of the fourth node Ne4 is maintained because the transistor M4 is in a turn-off state.

When the transistor M6 is turned on, the second terminal of the second capacitor C2 is electrically connected to the third input terminal 103. Because the transistor M5 is in a turn-off state, the first node Ne1 maintains a voltage of a high level.

At a fifth time point te5, the second clock signal of a low level is supplied to the third input terminal 103. Thereby, the transistor M4 and the transistor M5 are turned on. Because the third node Ne3 and the fifth node Ne5 are charged with the voltage of the second power supply VSS, the transistors M3 and M6 are in a turn-on state.

The second clock signal of a low level is applied to the first node Ne1 via the turn-on transistors M5 and M6, and the transistor M10 is turned on. If the transistor M10 is turned on, a voltage of the first power supply VDD is supplied to the output terminal 104 as a light emission signal. Accordingly, the light emission signal of a high level may be supplied to the first light emission line E1. For example, the first light emission stop pulse P1 may be supplied to the first light emission line E1.

When the transistor M3 and the transistor M4 are turned on, the voltage of the second power supply VDD is supplied to the fourth node Ne4 and the second node Ne2. Thereby, the transistor M8 and the transistor M11 may stably maintain a turn-off state.

When the second clock signal of a low level is supplied to the second terminal of the second capacitor C2, a voltage of the fifth node Ne5 drops to a voltage lower than the voltage of the second power supply VSS by coupling of the second capacitor C2. Thereby, a voltage applied to a gate electrode of the transistor M6 drops to a voltage lower than the voltage of the second power supply VSS, and thus, driving characteristic of the transistor M6 may be improved.

The voltage of the third node Ne3 may be maintained as substantially the voltage of the second power supply VSS regardless of the voltage of the fifth node Ne5 by the transistor M1. Because the voltage of the second power supply VSS is continuously applied to the gate electrode of the transistor M1, the voltage of the third node Ne3 corresponding to the source electrode of the transistor M1 does not drop to a voltage lower than or equal to a voltage obtained by adding the threshold voltage to the voltage of the second power supply VSS. Accordingly, the third node Ne3 may maintain substantially the voltage of the second power supply VSS regardless of the voltage drop of the fifth node Ne5. In this case, a voltage difference between the source electrode and the drain electrode of the transistor M8 is reduced (e.g., minimized), and thereby, it is possible to prevent characteristics of the transistor M8 from changing.

At a sixth time point te6, the first clock signal of a low level is supplied to the second input terminal 102. Thereby, the transistor M7 and the transistor M9 are turned on. At this time, supplying the light emission stop start pulse ESP may be stopped.

When the transistor M7 is turned on, the fourth node Ne4 and the second node Ne2 are electrically connected to the first input terminal 101, and thereby, a voltage of a low level from the first input terminal 101 is supplied to the fourth node Ne4 and the second node Ne2. Thereby, the transistor M8, the transistor M11, and the transistor M12 are turned on.

When the transistor M8 is turned on, the first clock signal of a low level is supplied to the third node Ne3 and the fifth node Ne5.

When the transistor M12 is turned on, the voltage of the first power supply VDD is supplied to the first node Ne1, and the transistor M10 is turned off.

When the transistor M11 is turned on, the voltage of the second power supply VSS is supplied to the output terminal 104. Accordingly, a light emission signal of a low level may be supplied to the first light emission line E1. For example, supplying the first light emission stop pulse P1 to the first light emission line E1 may be stopped.

The second light emission stage ST2 receiving the light emission signal from the output terminal 104 of the first light emission stage ST1 also supplies a light emission signal to the second light emission line E2 while repeating the above-described processes. For example, the light emission stages according to some example embodiments of the present invention may sequentially supply the light emission stop pulses to the light emission lines E1 to Eo while repeating the above-described processes.

According to the above description, by adjusting the width (e.g., an interval between the fourth time point te4 and the sixth time point te6) of the light emission stop start pulse ESP, the widths of the light emission stop pulses P1, P2, and P3 of a turn-off level of the light emission signals may be adjusted.

Figure 7:
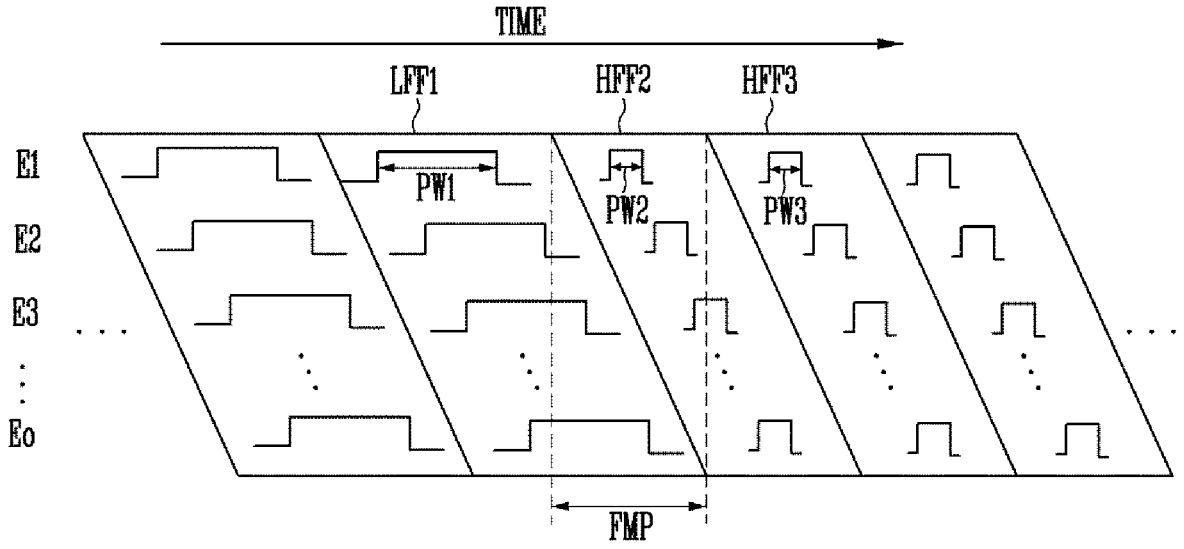
FIG. 7 is a diagram illustrating an instantaneous luminance change that occurs when a driving frequency is changed from a low frequency to a high frequency.

FIG. 7 is a diagram illustrating an instantaneous luminance change occurring when the driving frequency changes from a low frequency to a high frequency.

The display device 10 may be driven at a first frequency in a first frame LFF1 and the previous frames. The display device 10 may be driven at a second frequency after the first frame LFF1. For example, the display device 10 may be driven at the second frequency in a second frame HFF2, a third frame HFF3, and subsequent frames. Here, the first frequency and the second frequency may be different from each other.

In FIG. 7, a case where the first frequency is lower than the second frequency will be described as an example. That is, as illustrated in FIG. 7, the display device 10 may be driven at a low frequency up to the first frame LFF1 and may be driven at a high frequency after the second frame HFF2.

The light emission driver 14 may supply a pixel with the first light emission stop pulse having a first pulse width PW1 through the first light emission line E1 in the first frame LFF1 driven at the first frequency.

The light emission driver 14 may supply the pixel with a second light emission stop pulse having a second pulse width PW2 through the first light emission line E1 in the second frame HFF2 driven at the second frequency.

The light emission driver 14 may supply the pixel with a third light emission stop pulse having a third pulse width PW3 through the first light emission line E1 in the third frame HFF3 driven at the second frequency.

A second frame period of the second frame HFF2 driven at a high frequency is shorter than a first frame period of the first frame LFF1 driven at a low frequency. Accordingly, in order to adjust an emission duty ratio, the second pulse width PW2 in the second frame period may be shorter than the first pulse width PW1. The emission duty ratio may mean a ratio between a light emission cycle and a non-emission cycle of a light emitting diode in one cycle. A third pulse width PW3 in the third frame HFF3 driven at a second frequency may be equal to the second pulse width PW2. A third frame period of the third frame HFF3 may be equal to the second frame period.

A frequency mixed period FMP in which the first frame period overlaps the second frame period may occur. In the frequency mixed period FMP, the first pulse width PW1 corresponding to the first frequency and the second pulse width PW2 corresponding to the second frequency may exist at the same time. Accordingly, the light emitting diodes of the pixel unit 15 may be driven with different emission duty ratios, and a user may visually recognize an instantaneous luminance change such as a flashing phenomenon.

Figure 8:
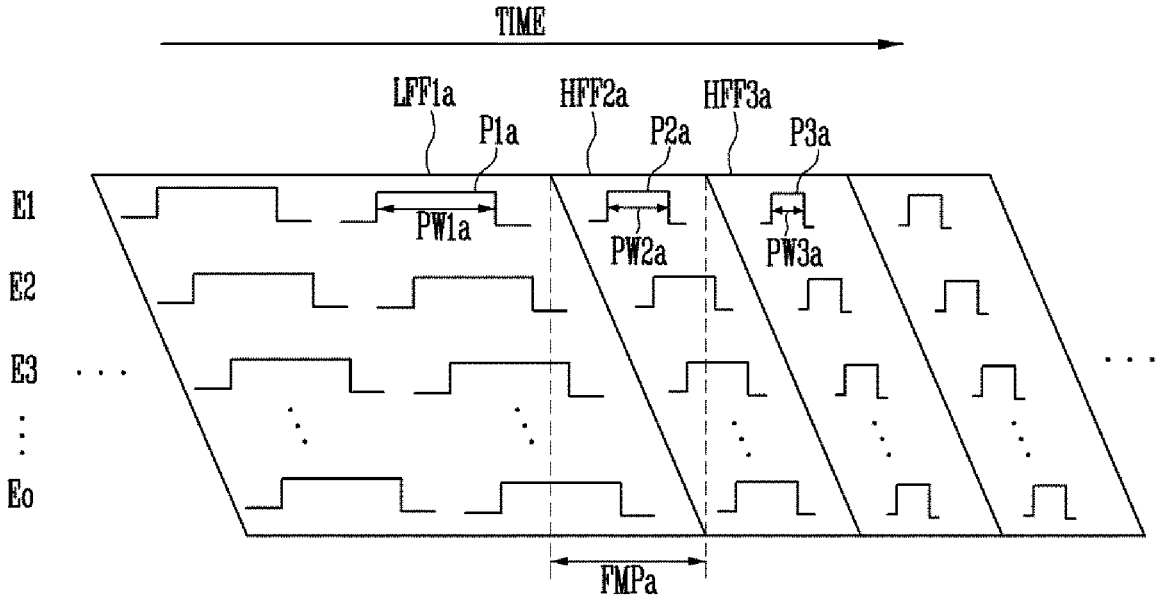
FIGS. 8-10 are diagrams illustrating aspects of some example embodiments for minimizing or reducing a luminance change in a case of FIG. 7.
Figure 9:
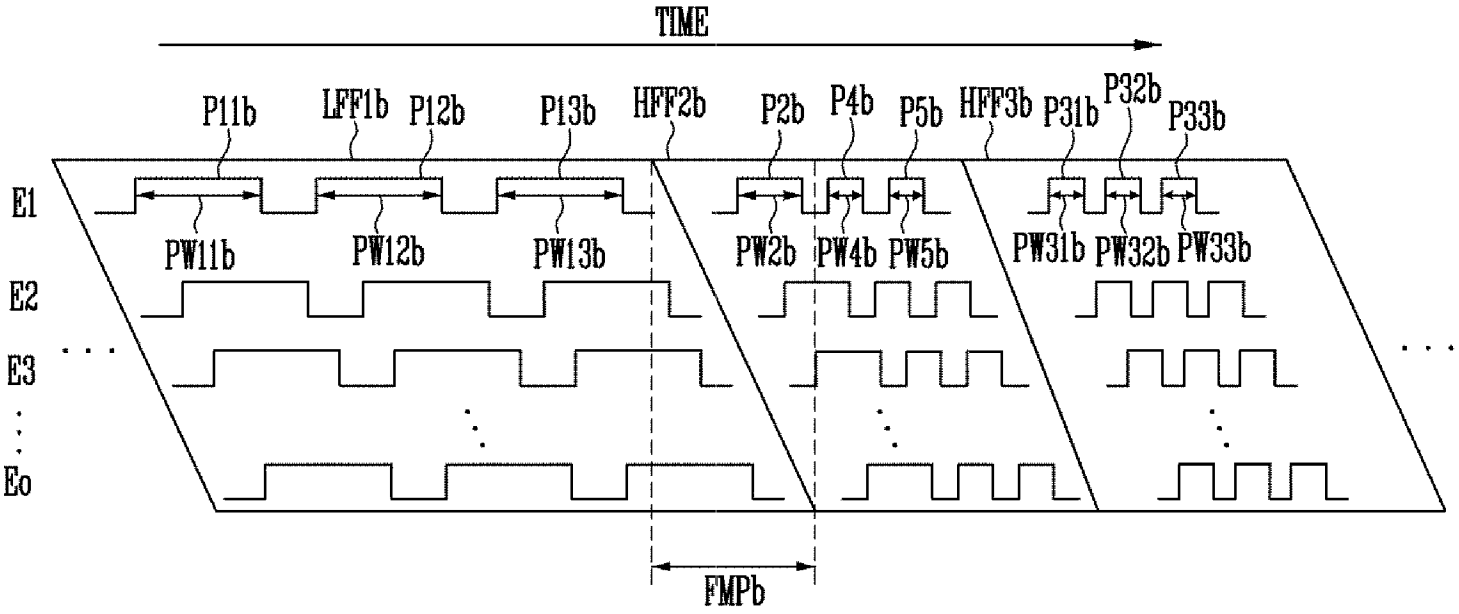
Figure 10:
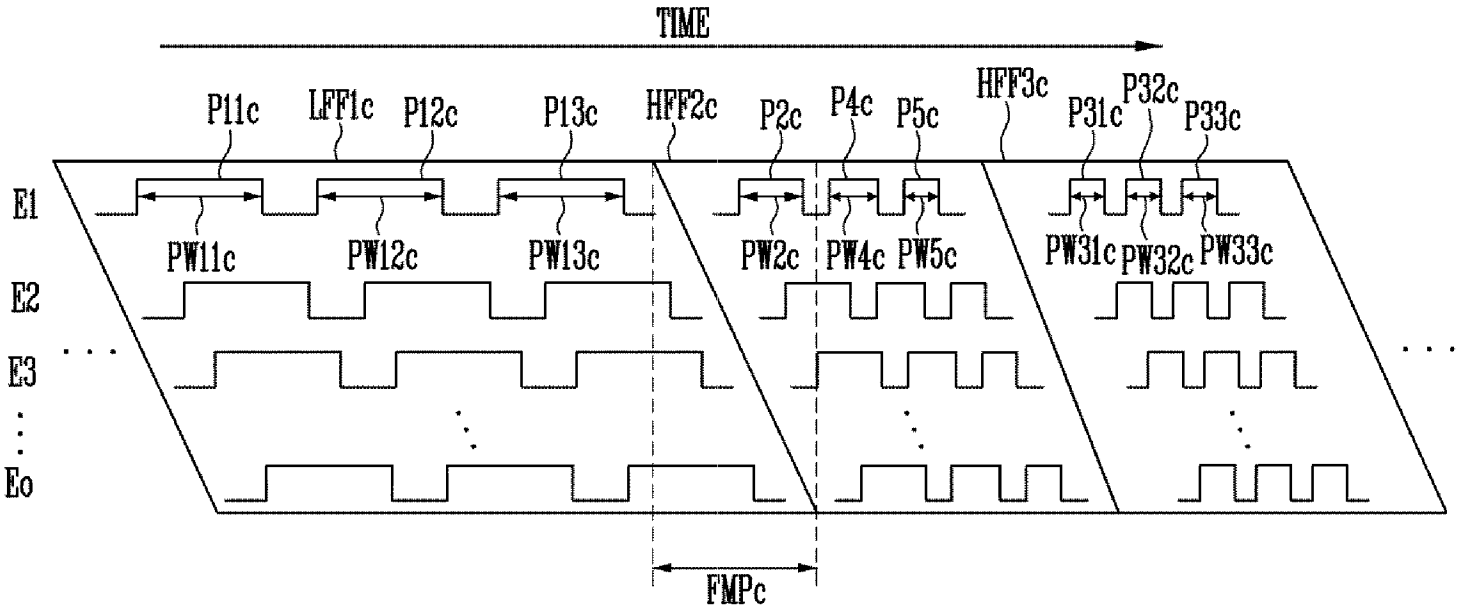

FIGS. 8-10 are diagrams illustrating aspects of some example embodiments for minimizing a luminance change in the case of FIG. 7.

Aspects of the example embodiment of FIG. 8 will be described first.

The light emission driver 14 may supply a pixel with a first light emission stop pulse P1*a* having a first pulse width PW1*a* through the first light emission line E1 in a first frame LFF1*a* driven at a first frequency.

The light emission driver 14 may supply the pixel with a second light emission stop pulse P2*a* having a second pulse width PW2*a* through the first light emission line E1 in a second frame HFF2*a* driven at a second frequency.

The light emission driver 14 may supply the pixel with a third light emission stop pulse P3*a* having a third pulse width PW3*a* through the first light emission line E1 in a third frame HFF3*a* driven at the second frequency.

The first frequency and the second frequency may be different from each other. For example, the first frequency may be lower than the second frequency.

The second pulse width PW2*a* may be between the first pulse width PW1*a* and the third pulse width PW3*a*. For example, the second pulse width PW2*a* may be smaller than the first pulse width PW1*a* and may be larger than the third pulse width PW3*a*.

According to some example embodiments, a difference in emission duty ratio between the first frame LFF1*a* and the second frame HFF2*a* is reduced in a frequency mixed period FMPa, and thus, an instantaneous luminance change may be reduced.

According to some example embodiments, the timing controller 11 may increase gray scale values of the second frame HFF2*a* so as to compensate for the reduced emission duty ratio of the second frame HFF2*a*. For example, the timing controller 11 may increase the gray level values of the second frame HFF2*a* received from an external processor and provide the gray level values to the data driver 12. The timing controller 11 may maintain the gray level values of the first frame LFF1*a* and the third frame HFF3*a* received from the external processor and provide the same to the data driver 12.

Aspects of the example embodiment of FIG. 9 will now be described.

The light emission driver 14 may supply a pixel with a first light emission stop pulse P11*b* having a first pulse width PW11*b* through the first light emission line E1 in a first frame LFF1*b* driven at a first frequency.

The light emission driver 14 may supply the pixel with a second light emission stop pulse P2*b* having a second pulse width PW2*b* through the first light emission line E1 in a second frame HFF2*b* driven at a second frequency.

The light emission driver 14 may supply the pixel with a third light emission stop pulse P31*b* having a third pulse width PW31*b* through the first light emission line E1 in a third frame HFF3*b* driven at the second frequency.

The first frequency and the second frequency may be different from each other. For example, the first frequency may be lower than the second frequency.

The second pulse width PW2*b* may be between the first pulse width PW11*b* and the third pulse width PW31*b*. For example, the second pulse width PW2*b* may be smaller than the first pulse width PW11*b* and may be larger than the third pulse width PW31*b*.

The light emission driver 14 may further supply a pixel with at least one of the light emission stop pulses P12*b* and P13*b* respectively having the same pulse widths PW12*b* and PW13*b* as the first pulse width PW11*b* through the first light emission line E1 in the first frame LFF1*b*.

The light emission driver 14 may further supply the pixel with at least one of the light emission stop pulses P32*b* and P33*b* respectively having the same pulse widths PW32*b* and PW33*b* as third pulse width PW31*b* through the first light emission line E1 in the third frame HFF3*b*.

The light emission driver 14 may further supply the pixel with at least one of the light emission stop pulses P4*b* and P5*b* respectively having the same pulse width PW4*b* and PW5*b* as the third pulse width PW31*b* through the first light emission line E1 in the second frame HFF2*b*, following the second light emission stop pulse P2*b*.

According to some example embodiments, a difference in the emission duty ratio between the first frame LFF1*b* and the second frame HFF2*b* is reduced in the frequency mixed period FMPb, and thus, an instantaneous luminance change may be reduced.

For example, when each of the light emission signals includes a plurality of light emission stop pulses as illustrated in FIG. 9, the preceding light emission stop pulse P2*b* of the plurality of light emission stop pulses in the second frame HFF2*b* is of great importance in the frequency mixed period FMPb. Accordingly, by adjusting only the pulse width PW2*b* of the preceding light emission stop pulse P2*b* in the second frame HFF2*b*, an instantaneous luminance change may be reduced.

According to some example embodiments, the timing controller 11 may increase gray scale values of the second frame HFF2*b* so as to compensate for the reduced emission duty ratio of the second frame HFF2*b*. For example, the timing controller 11 may increase the gray scale values of the second frame HFF2*b* received from an external processor and provide the gray scale values to the data driver 12. The timing controller 11 may maintain the gray scale values of the first frame LFF1*b* and the third frame HFF3*b* received from the external processor and provide the same to the data driver 12.

Aspects of the example embodiment of FIG. 10 will now be described.

The light emission driver 14 may supply a pixel with a first light emission stop pulse P11*c* having a first pulse width PW11*c* through the first light emission line E1 in a first frame LFF1*c* driven at a first frequency.

The light emission driver 14 may supply the pixel with a second light emission stop pulse P2*c* having a second pulse width PW2*c* through the first light emission line E1 in a second frame HFF2*c* driven at a second frequency.

The light emission driver 14 may supply the pixel with a third light emission stop pulse P31*c* having a third pulse width PW31*c* through the first light emission line E1 in a third frame HFF3*c* driven at the second frequency.

The first frequency and the second frequency may be different from each other. For example, the first frequency may be lower than the second frequency.

The second pulse width PW2*c* may be between the first pulse width PW11*c* and the third pulse width PW31*c*. For example, the second pulse width PW2*c* may be smaller than the first pulse width PW11*c* and may be larger than the third pulse width PW31*c*.

The light emission driver 14 may further supply a pixel with at least one of light emission stop pulses P12*c* and P13*c* respectively having the same pulse widths PW12*c* and PW13*c* as the first pulse width PW11*c* through the first light emission line E1 in the first frame LFF1*c*.

The light emission driver 14 may further supply the pixel at least one of the light emission stop pulses P32*c* and P33*c* respectively having the same pulse widths PW32*c* and PW33*c* as the third pulse width PW31*c* through the first light emission line E1 in the third frame HFF3*c*.

The light emission driver 14 may further supply the pixel with at least one fourth light emission stop pulse P4*c* having a fourth pulse width PW4*c* between the second pulse width PW2*c* and the third pulse width PW31*c* through the first light emission line E1 in the second frame HFF2*c*, following the second light emission stop pulse P2*c*.

The light emission driver 14 may further supply the pixel with at least one fifth light emission stop pulse P5*c* having a fifth pulse width PW5*c* smaller than the fourth pulse width PW4*c* and larger than or equal to the third pulse width PW31*c* through the first light emission line E1 in the second frame HFF2*c*, following the fourth light emission stop pulse P4*c*.

According to some example embodiments, a difference in the emission duty ratio between the first frame LFF1*c* and the second frame HFF2*c* is reduced in a frequency mixed period FMPc, and thus, an instantaneous luminance variation may be reduced.

For example, when each of the light emission signals includes a plurality of light emission stop pulses as illustrated in FIG. 10, the preceding light emission stop pulses P2*c* and P4*c* among the plurality of light emission stop pulses of the second frame HFF2*c* are of great importance in the frequency mixed period FMPc. Accordingly, by adjusting the pulse widths PW2*c*, PW4*c*, and PW5*c* of the light emission stop pulses P2*c*, P4*c*, and P5*c* of the second frame HFF2*c* so as to be sequentially reduced, an instantaneous luminance change may be reduced.

According to some example embodiments, the timing controller 11 may increase gray scale values of the second frame HFF2*c* so as to compensate for the reduced emission duty ratio of the second frame HFF2*c*. For example, the timing controller 11 may increase the gray scale values of the second frame HFF2*c* received from an external processor and provide the gray scale values to the data driver 12. The timing controller 11 may maintain the gray scale values of the first frame LFF1*c* and the third frame HFF3*c* received from the external processor and provide the same to the data driver 12.

Figure 11:
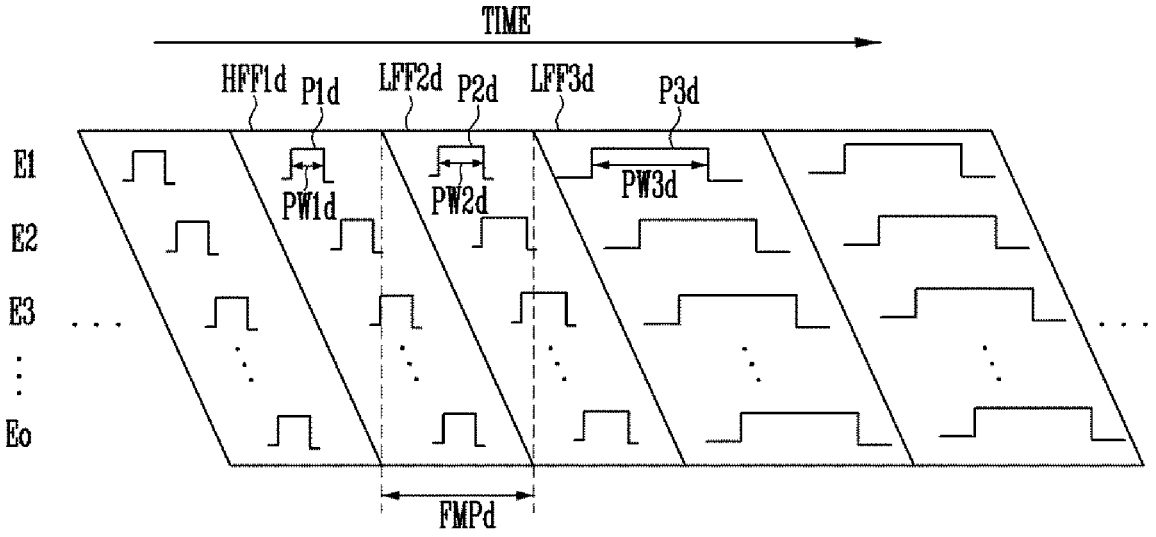
FIGS. 11-13 are diagrams illustrating example embodiments for minimizing or reducing a luminance change when the driving frequency is changed from a high frequency to a low frequency.
Figure 12:
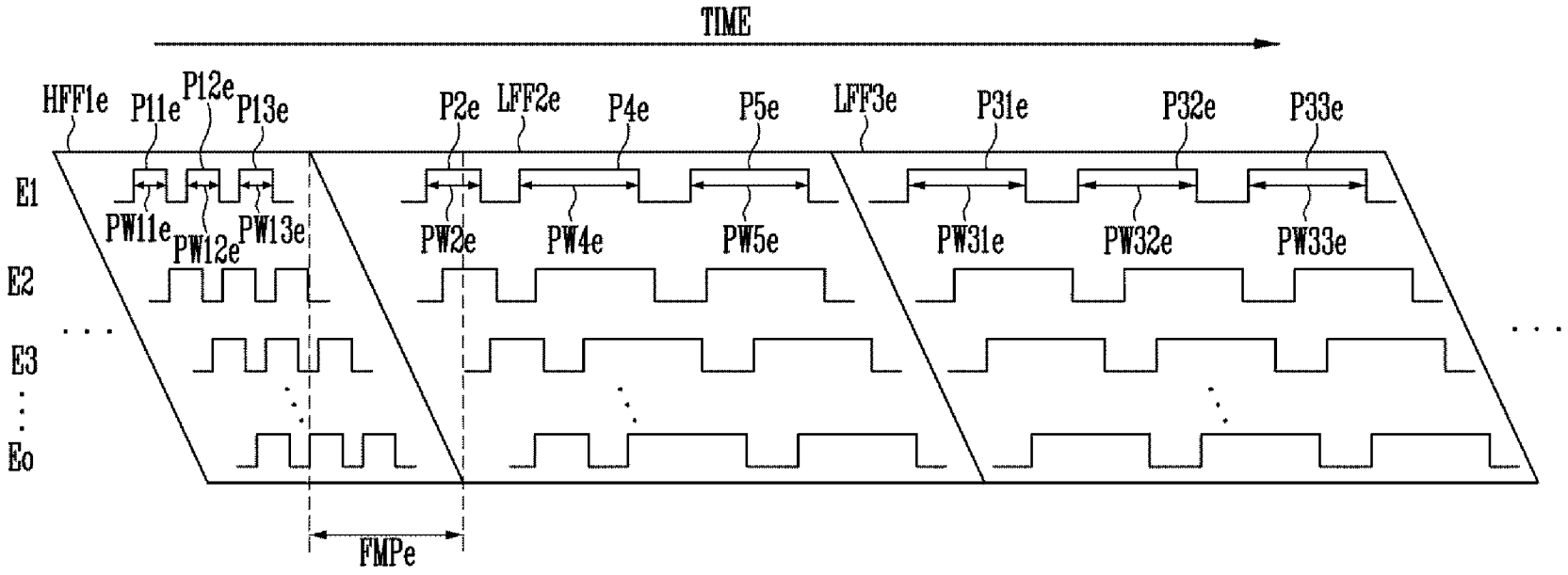
Figure 13:
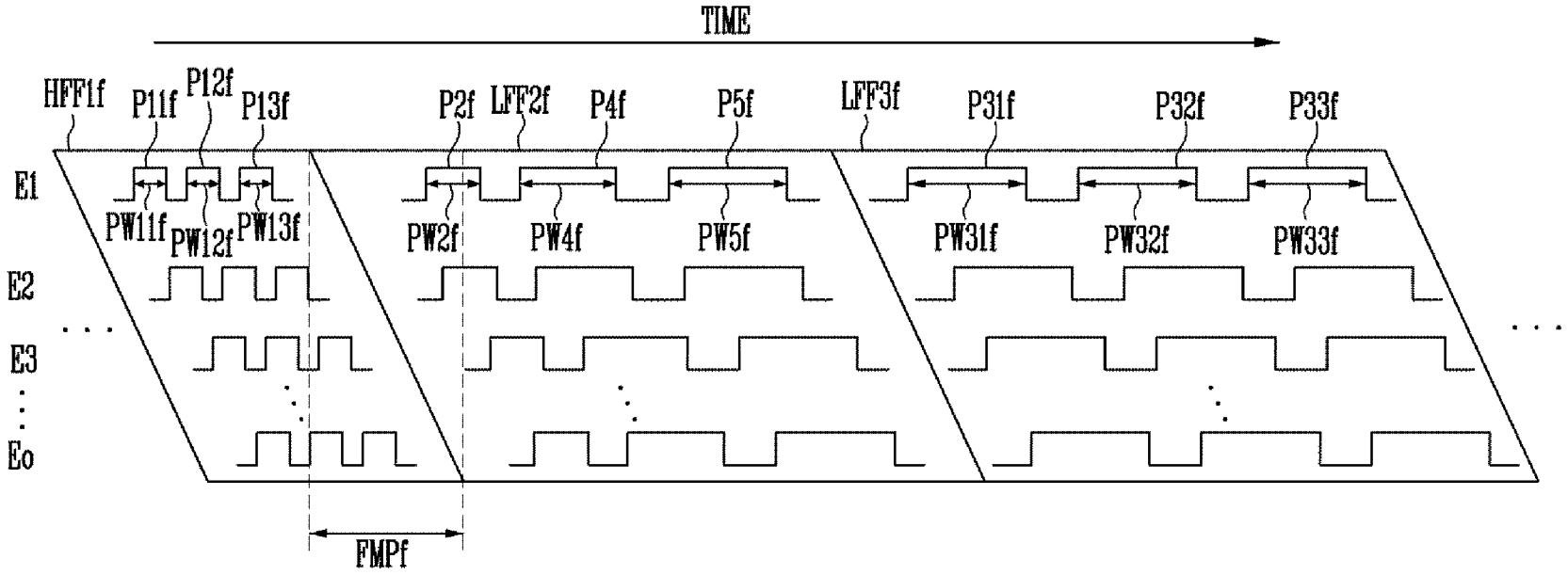

FIGS. 11-13 are diagrams illustrating the example embodiments for minimizing a luminance change when a driving frequency changes from a high frequency to a low frequency.

FIG. 7 illustrates a case where the driving frequency of the display device 10 changes from the low frequency to the high frequency, but even when the driving frequency changes from the high frequency to the low frequency, the frequency mixed period occurs, and thus, a user may visually recognize an instantaneous luminance change such as a flashing phenomenon.

Hereinafter, aspects of the example embodiment of FIG. 11 will be described.

The light emission driver 14 may supply a pixel with a first light emission stop pulse P1*d* having a first pulse width PW1*d* through the first light emission line E1 in a first frame HFF1*d* driven at a first frequency.

The light emission driver 14 may supply the pixel with a second light emission stop pulse P2*d* having a second pulse width PW2*d* through the first light emission line E1 in the second frame LFF2*d* driven at a second frequency.

The light emission driver 14 may supply the pixel with a third light emission stop pulse P3*d* having a third pulse width PW3*d* through the first light emission line E1 in a third frame LFF3*d* driven at the second frequency.

The first frequency and the second frequency may be different from each other. For example, the first frequency may be higher than the second frequency.

The second pulse width PW2*d* may be between the first pulse width PW1*d* and the third pulse width PW3*d*. For example, the second pulse width PW2*d* may be larger than the first pulse width PW1*d* and may be smaller than the third pulse width PW3*d*.

According to some example embodiments, a difference in the emission duty ratio between the first frame HFF1*d* and the second frame LFF2*d* is reduced in the frequency mixed period FMPd, and thus an instantaneous luminance change may be reduced.

According to some example embodiments, the timing controller 11 may reduce gray scale values of the second frame LFF2*d* so as to compensate for the increased emission duty ratio of the second frame LFF2*d*. For example, the timing controller 11 may reduce the gray level values of the second frame LFF2*d* received from the external processor and provide the gray scale values to the data driver 12. The timing controller 11 may maintain the gray scale values of the first frame HFF1*d* and the third frame LFF3*d* received from the external processor and provide the same to the data driver 12.

Aspects of the example embodiment of FIG. 12 will now be described.

The light emission driver 14 may supply a pixel with a first light emission stop pulse P11*e* having a first pulse width PW11*e* through the first light emission line E1 in a first frame HFF1*e* driven at a first frequency.

The light emission driver 14 may supply the pixel with a second light emission stop pulse P2*e* having a second pulse width PW2*e* through the first light emission line E1 in a second frame LFF2*e* driven at a second frequency.

The light emission driver 14 may supply the pixel with a third light emission stop pulse P31*e* having a third pulse width PW31*e* through the first light emission line E1 in a third frame LFF3*e* driven at the second frequency.

The first frequency and the second frequency may be different from each other. For example, the first frequency may be higher than the second frequency.

The second pulse width PW2*e* may be between the first pulse width PW11*e* and the third pulse width PW31*e*. For example, the second pulse width PW2*e* may be larger than the first pulse width PW11*e* and may be smaller than the third pulse width PW31*e*.

The light emission driver 14 may further supply a pixel with at least one of light emission stop pulses P12*e* and P13*e* respectively having the same pulse widths PW12*e* and PW13*e* as the first pulse width PW11*e* through the first light emission line E1 in the first frame HFF1*e*.

The light emission driver 14 may further supply the pixel with at least one of light emission stop pulses P32*e* and P33*e* respectively having the same pulse widths PW32*e* and PW33*e* as the third pulse width PW31*e* through the first light emission line E1 in the third frame LFF3*e*.

The light emission driver 14 may further supply the pixel with at least one of light emission stop pulses P4*e* and P5*e* respectively having the same pulse widths PW4*e* and PW5*e* as the third pulse width PW31*e* through the first light emission line E1 in the second frame LFF2*e*, following the second light emission stop pulse P2*e*.

According to some example embodiments, a difference in the emission duty ratio between the first frame HFF1*e* and the second frame LFF2*e* is reduced in the frequency mixed period FMPe, and thus, an instantaneous luminance change may be reduced.

For example, when each of the light emission signals includes a plurality of light emission stop pulses as illustrated in FIG. 12, the preceding light emission stop pulse P2*e* among the plurality of light emission stop pulses of the second frame LFF2*e* is of great importance in the frequency mixed period FMPe. Accordingly, by adjusting only the pulse width PW2*e* of the preceding light emission stop pulse P2*e* in the second frame LFF2*e*, the instantaneous luminance change may be reduced.

According to some example embodiments, the timing controller 11 may reduce gray scale values of the second frame LFF2*e* so as to compensate for the increased emission duty ratio of the second frame LFF2*e*. For example, the timing controller 11 may reduce the gray scale values of the second frame LFF2*e* received from an external processor and provide the gray scale values to the data driver 12. The timing controller 11 may maintain the gray scale values of the first frame HFF1*e* and the third frame LFF3*e* received from the external processor and provide the same to the data driver 12.

Aspects of the example embodiment of FIG. 13 will now be described.

The light emission driver 14 may supply a pixel with a first light emission stop pulse P11*f* having a first pulse width PW11*f* through the first light emission line E1 in a first frame HFF1*f* driven at a first frequency.

The light emission driver 14 may supply the pixel with a second light emission stop pulse P2*f* having a second pulse width PW2*f* through the first light emission line E1 in a second frame LFF2*f* driven at the second frequency.

The light emission driver 14 may supply the pixel with a third light emission stop pulse P31*f* having a third pulse width PW31*f* through the first light emission line E1 in a third frame LFF3*f* driven at the second frequency.

The first frequency and the second frequency may be different from each other. For example, the first frequency may be higher than the second frequency.

The second pulse width PW2*f* may be between the first pulse width PW11*f* and the third pulse width PW31*f*. For example, the second pulse width PW2*f* may be larger than the first pulse width PW11*f* and may be smaller than the third pulse width PW31*f*.

The light emission driver 14 may further supply a pixel with at least one of light emission stop pulses P12*f* and P13*f* respectively having the same pulse widths PW12*f* and PW13*f* as the first pulse width PW11*f* through the first light emission line E1 in the first frame HFF1*f*.

The light emission driver 14 may further supply the pixel with at least one of light emission stop pulses P32*f* and P33*f* respectively having the same pulse widths PW32*f* and PW33*f* as the third pulse width PW31*f* through the first light emission line E1 in the third frame LFF3*f*.

The light emission driver 14 may further supply the pixel with at least one fourth light emission stop pulse P4*f* having a fourth pulse width PW4*f* between the second pulse width PW2*f* and the third pulse width PW31*f* through the first light emission line E1 in the second frame LFF2*f*, following the second light emission stop pulse P2*f*.

The light emission driver 14 may further supply at least one fifth light emission stop pulse P5*f* having a fifth pulse width PW5*f* larger than the fourth pulse width PW4*f* and smaller than or equal to the third pulse width PW31*f* to the pixel through the first light emission line E1 in the second frame LFF2*f*, following the fourth light emission stop pulse P4*f*.

According to some example embodiments, a difference in the emission duty ratio between the first frame HFF1*f* and the second frame LFF2*f* is reduced in a frequency mixed period FMPf, and thus, an instantaneous luminance change may be reduced.

For example, when each of the light emission signals includes a plurality of light emission stop pulses as illustrated in FIG. 13, the preceding light emission stop pulses P2*f* and P4*f* among the plurality of light emission stop pulses of the second frame LFF2*f* are of great importance in a frequency mixed period FMPf. Accordingly, by adjusting the pulse widths PW2*f*, PW4*f*, and PW5*f* of the light emission stop pulses P2*f*, P4*f*, and P5*f* of the second frame LFF2*f* so as to be sequentially reduced, an instantaneous luminance change may be reduced.

According to some example embodiments, the timing controller 11 may reduce gray scale values of the second frame LFF2*f* so as to compensate for the increased emission duty ratio of the second frame LFF2*f*. For example, the timing controller 11 may reduce the gray scale values of the second frame LFF2*f* received from an external processor and provide the gray scale values to the data driver 12. The timing controller 11 may maintain the gray scale values of the first frame HFF1*f* and the third frame LFF3*f* received from the external processor and provide them to the data driver 12.

The drawings referred to so far and the detailed description of the invention are merely examples for the invention, are used only for the purpose of describing the present invention and are not to be construed as limiting the scope of the present invention as defined by the appended claims. Accordingly, those skilled in the art will appreciate that various modifications and equivalent embodiments are possible therefrom. Thus, the true scope of the present invention should be determined by the technical idea of the appended claims and their equivalents.

What is claimed is:

1. A driving method of a display device comprising:

supplying a pixel with a first light emission stop pulse having a first pulse width during a first frame that is driven at a first frequency;

supplying the pixel with a second light emission stop pulse having a second pulse width during a second frame that is driven at a second frequency; and supplying the pixel with a third light emission stop pulse having a third pulse width during a third frame that is driven at the second frequency, wherein the first frequency is different from the second frequency, and wherein a size of the second pulse width is between those of the first pulse width and the third pulse width.

2. The driving method of the display device according to claim 1, wherein the first frequency is lower than the second frequency, and wherein the second pulse width is smaller than the first pulse width and is larger than the third pulse width.

3. The driving method of the display device according to claim 2, wherein at least one light emission stop pulse having the first pulse width is further supplied to the pixel during the first frame.

4. The driving method of the display device according to claim 3, wherein at least one light emission stop pulse having the third pulse width is further supplied to the pixel during the third frame.

5. The driving method of the display device according to claim 4, wherein at least one light emission stop pulse having the third pulse width is further supplied to the pixel during the second frame, following the second light emission stop pulse.

6. The driving method of the display device according to claim 4, wherein at least one fourth light emission stop pulse having a fourth pulse width that is between the second pulse width and the third pulse width is further supplied to the pixel during the second frame, following the second light emission stop pulse.

7. The driving method of the display device according to claim 6, wherein at least one fifth light emission stop pulse having a fifth pulse width smaller than the fourth pulse width and larger than or equal to the third pulse width is further supplied to the pixel during the second frame, following the fourth light emission stop pulse.

8. A driving method of a display device comprising:

supplying a pixel with a first light emission stop pulse having a first pulse width during a first frame that is driven at a first frequency;

supplying the pixel with a second light emission stop pulse having a second pulse width during a second frame that is driven at a second frequency; and supplying the pixel with a third light emission stop pulse having a third pulse width during a third frame that is driven at the second frequency, wherein the first frequency is different from the second frequency, wherein the second pulse width is between the first pulse width and the third pulse width, wherein the first frequency is higher than the second frequency, and wherein the second pulse width is larger than the first pulse width and is smaller than the third pulse width.

9. The driving method of the display device according to claim 8, wherein at least one light emission stop pulse having the first pulse width is further supplied to the pixel during the first frame.

10. The driving method of the display device according to claim 9, wherein at least one light emission stop pulse having the third pulse width is further supplied to the pixel during the third frame.

11. The driving method of the display device according to claim 10, wherein at least one light emission stop pulse having the third pulse width is further supplied to the pixel during the second frame, following the second light emission stop pulse.

12. The driving method of the display device according to claim 10, wherein at least one fourth light emission stop pulse having a fourth pulse width which is between the second pulse width and the third pulse width is further supplied to the pixel during the second frame, following the second light emission stop pulse.

13. The driving method of the display device according to claim 12, wherein at least one fifth light emission stop pulse having a fifth pulse width larger than the fourth pulse width and smaller than or equal to the third pulse width is further supplied to the pixel during the second frame, following the fourth light emission stop pulse.

14. A display device comprising:

a light emission driver;

a first pixel which is coupled to a first light emission line extending from the light emission driver; and a second pixel that is connected to a second light emission line which extends from the light emission driver and differs from the first light emission line, wherein the light emission driver supplies a first pixel with a first light emission stop pulse having a first pulse width during a first frame that is driven at a first frequency, supplies the first pixel with a second light emission stop pulse having a second pulse width during a second frame that is driven at a second frequency, and supplies the first pixel with a third light emission stop pulse having a third pulse width during a third frame driven at the second frequency, wherein the light emission driver supplies light emission stop pulses to the second pixel at a different time from the first pixel, during each frame, and wherein a size of the second pulse width is between those of the first pulse width and the third pulse width.

15. The display device according to claim 14, wherein the first frequency is lower than the second frequency, wherein the second pulse width is smaller than the first pulse width and is larger than the third pulse width, wherein the light emission driver further supplies the first pixel with at least one light emission stop pulse having the first pulse width during the first frame, and wherein the light emission driver further supplies the first pixel with at least one light emission stop pulse having the third pulse width during the third frame.

16. The display device according to claim 15, wherein the light emission driver further supplies the first pixel with at least one light emission stop pulse having the third pulse width during the second frame, following the second light emission stop pulse.

17. The display device according to claim 15, wherein the light emission driver further supplies the first pixel with at least one fourth light emission stop pulse having a fourth pulse width between the second pulse width and the third pulse width during the second frame, following the second light emission stop pulse, and wherein the light emission driver further supplies the first pixel with at least one fifth light emission stop pulse having a fifth pulse width smaller than the fourth pulse width and larger than or equal to the third pulse width during the second frame, following the fourth light emission stop pulse.

18. The display device according to claim 14, wherein the first frequency is higher than the second frequency, wherein the second pulse width is larger than the first pulse width and is smaller than the third pulse width, wherein the light emission driver further supplies the first pixel with at least one light emission stop pulse having the first pulse width during the first frame, and wherein the light emission driver further supplies the first pixel with at least one light emission stop pulse having the third pulse width during the third frame.

19. The display device according to claim 18, wherein the light emission driver further supplies the first pixel with at least one light emission stop pulse having the third pulse width during the second frame, following the second light emission stop pulse.

20. The display device according to claim 18, wherein the light emission driver further supplies the first pixel with at least one fourth light emission stop pulse having a fourth pulse width between the second pulse width and the third pulse width during the second frame, following the second light emission stop pulse, and wherein the light emission driver further supplies the first pixel with at least one fifth light emission stop pulse having a fifth pulse width larger than the fourth pulse width and smaller than or equal to the third pulse width during the second frame, following the fourth light emission stop pulse.

* * * * *